US007315714B2

(12) United States Patent
Wakahara

(10) Patent No.: US 7,315,714 B2
(45) Date of Patent: Jan. 1, 2008

(54) IMAGE FORMING APPARATUS INCLUDING A CONTROLLER FOR CONTROLLING A MOVING SPEED OF A MOVING MEMBER HOLDING A PLURALITY OF DEVELOPING DEVICES

(75) Inventor: Shinichiro Wakahara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/538,653

(22) Filed: Oct. 4, 2006

(65) Prior Publication Data

US 2007/0077092 A1 Apr. 5, 2007

Related U.S. Application Data

(62) Division of application No. 11/033,723, filed on Jan. 13, 2005, now Pat. No. 7,155,147.

(30) Foreign Application Priority Data

Jan. 15, 2004 (JP) ..... 2004-008557

(51) Int. Cl.
*G03G 15/01* (2006.01)

(52) U.S. Cl. ..... 399/227; 399/228

(58) Field of Classification Search ..... 399/227, 399/223, 226, 53, 228, 54, 236
See application file for complete search history.

(56) References Cited

U.S. PATENT DOCUMENTS 5,210,584 A 5/1993 Ogino et al. ..... 355/227
5,552,877 A 9/1996 Ishikawa et al. ..... 355/326 R
6,201,939 B1 3/2001 Yamamoto et al. ..... 399/227
6,317,572 B1 11/2001 Miyabe et al. ..... 399/111
6,393,239 B1 5/2002 Arcaro et al. ..... 399/227

FOREIGN PATENT DOCUMENTS

JP 8-114963 5/1996
JP 3372697 11/2002

*Primary Examiner*—David M. Gray
*Assistant Examiner*—Laura K Roth
(74) *Attorney, Agent, or Firm*—Fitzpatrick, Cella, Harper & Scinto

(57) ABSTRACT

An image forming apparatus includes a controller controlling a movement of a moving member to successively move a plurality of developing devices to a developing position in an image forming operation. A moving distance in at least one moving operation is different from a moving distance in other moving operations. A controller performs at least one moving operation and other moving operations during a transfer operation by a primary transferring device. The controller controls a moving speed of the moving member so that a relative position of a trailing edge of an image forming region on the image bearing member with respect to the developing position is controlled for the at least one moving operation and the other moving operations and so that the moving speed is uniform when the moving member performs a developer supplying operation in a non-image forming operation.

3 Claims, 13 Drawing Sheets

Bk
Y
M
C
O
HP
1
4
5
50
51
5Bk
5C
5M
5Y
11Bk
11C
11M
11Y

EXPOSURE DATA IN IDEAL POSITION
Y M C Bk
POSITION MISREGISTER

AFTER PRIMARY TRANSFER
Y M C Bk
COLOR MISREGISTER

EXPOSURE DATA IN IDEAL POSITION
Y M C Bk
POSITION MISREGISTER

AFTER SECONDARY TRANSFER
Y M C Bk
WITHOUT COLOR MISREGISTER
OUT OF PITCH

IMAGE FORMING APPARATUS INCLUDING A CONTROLLER FOR CONTROLLING A MOVING SPEED OF A MOVING MEMBER HOLDING A PLURALITY OF DEVELOPING DEVICES

CROSS-REFERENCE TO RELATED APPLICATION

This application is a divisional of application Ser. No. 11/033,723, filed Jan. 13, 2005 now U.S. Pat. No. 7,155,147.

BACKGROUND OF THE INVENTION

1. Field of the Invention

The invention relates to an image forming apparatus using an electrophotographic process or an electrostatic recording process, and particularly to an image forming apparatus using a developing apparatus provided with a plurality of developing devices and effecting the changeover of the developing device for effecting development on an image bearing member at the same developing position, by a rotating operation.

2. Related Background Art

Among color image forming apparatuses for forming a color image by the use of developers of a plurality of colors, i.e., image forming apparatuses provided with a plurality of developing devices which are developing means containing therein developers including toners of different colors, there is an image forming apparatus of a construction provided with a so-called rotary developing apparatus carrying a plurality of developing devices along the outer periphery of a moving member disposed at a position opposed to a single image bearing member, wherein the moving member is rotated to thereby successively bring the developing devices close to the image bearing member.

In the image forming apparatus of such a construction, such means as latent image forming means, charging means and cleaning means acting on the single image bearing member are provided only for the single image bearing member, as compared with an image forming apparatus of an in-line type provided with image bearing members for respective colors, and this leads to a low cost and space saving.

Also, as compared with an image forming apparatus in which a plurality of developing devices are not carried on a moving member, i.e., a rotary member, but are provided along the peripheral surface of a single image bearing member, the constructions of all the developing devices can be made the same and the developing position on the image bearing member can be set to one and therefore, the construction of the apparatus is simple and the maintainability of the apparatus can be improved.

In the color image forming apparatuses provided with such a rotary developing apparatus, there is further known a color image forming apparatus of an intermediate transfer type which can select the kinds of a recording material within a wide range, i.e., an intermediate transfer type using, as an intermediate transfer member, particularly a belt-shaped intermediate transfer member which can increase the degree of freedom with which it is disposed in the image forming apparatus, and which can achieve the downsizing and lower cost of the main body of the apparatus by the effective utilization of space.

With reference to FIG. 9 of the accompanying drawings, the general construction of an image forming apparatus adopting the electrophotographic process will hereinafter be described as an example of the above-described color image forming apparatus of the intermediate transfer type provided with the rotary developing apparatus.

In the image forming apparatus shown in FIG. 9, an ITB unit 2 having an intermediate transfer belt (ITB) 2*d* which is an intermediate transfer member is installed adjacent to a photosensitive drum 1 as an image bearing member, and this ITB unit 2 is constituted by the ITB 2*d* being stretched around a drive roller 2*a*, a secondary transfer inner roller 2*b* and a driven roller 2*c*. The ITB unit 2 is detachably fixed to the main body of the apparatus by a rotational position determining portion 2*h* and a drive roller reference portion 2*g* of an ITB frame 2*f* for supporting the rollers 2*a*, 2*b* and 2*c*. The ITB 2*d* is rotated by the drive roller 2*a* being rotated by a drive source (not shown) from the main body of the apparatus.

As the image forming process, the surface of the photosensitive drum 1 is uniformly charged by a charging device 1*a* (the charging step), and exposing means 3 (latent image forming means) exposes the charged surface to light, whereby electrostatic latent images of respective colors based on external information are successively formed (the latent image forming step), whereafter the electrostatic latent images on the photosensitive drum 1 are successively developed by developing devices 5 (5Y, 5M, 5C and 5Bk) of respective colors carried on a developing changeover mechanism (rotary) 4 which is the movable member of a rotary developing apparatus, and become developer images (toner images) (the developing step). The toner images on the photosensitive drum 1 are successively primary-transferred onto the ITB 2*d* in a primary transferring portion T1 by a primary transfer roller 2*e* which is in contact with the ITB 2*d* from the back side thereof, whereby a multiplex transfer image comprising the toner images of plural colors superimposed one upon another is formed on the ITB 2*d*. Thereupon, a recording material is fed from a sheet supplying cassette 6 to a second transferring portion T2 in which a secondary transfer inner roller 2*b* is disposed inside the ITB 2*d* and a secondary transfer outer roller 7 is disposed outside the ITB 2*d* opposed thereto, and the multiplex transfer image formed on the ITB 2*d* is secondary-transferred onto the recording material by the secondary transfer outer roller 7 (the transferring step). The recording material to which the multiplex transfer image has been transferred is sent to a fixing unit 8, where the toners thereon are fused and fixed (the fixing step), and the recording material is as an image-formed material discharged from a sheet discharging portion 9 onto a sheet discharging tray 10.

As can be understood from FIG. 4 of the accompanying drawings, which is an enlarged view of the essential portions of the present image forming apparatus, a rotary 4 which is the developing changeover mechanism of a rotary developing apparatus which is a moving member carries the developing devices 5 (5Y, 5M, 5C and 5Bk) containing therein developers (toners) of yellow (Y), magenta (M), cyan (C) and black (Bk) colors, respectively, in the named order along the outer periphery thereof in a clockwise direction as viewed in FIG. 4, and is rotated counter-clockwise thereby move the respective developing devices 5 in succession to a position opposed to the photosensitive drum 1, i.e., a developing position 50. The toner supply to the developing devices 5 is done from supply containers 11 (11Y, 11M, 11C and 11Bk) of the respective colors adjacent to the respective developing devices 5 by the rotating operation of the rotary 4. That is, by the rotation of the rotary 4, a centrifugal force acts on the toners, and the toners are guided by a carrying projection 11*d* (see FIG. 11C of the accompanying drawings) provided in the interior of the supply container 11, and are carried to developing device delivery ports (not shown) provided in the developing devices 5.

Each developing device 5 is provided with a developing sleeve 51 which is a developer carrying member located on the rotational outer periphery side of the rotary 4 for carrying the toner contained in the developing device 5 to the outside. During development during which the developing device 5 is disposed at the developing position 50 opposed to the photosensitive drum 1, the developing sleeve 51 carries the toner in the developing device 5 to the electrostatic latent image formed on the surface of the photosensitive drum 1 and the developing operation is performed. At that time, a developing bias is applied to the developing sleeve 51 from a voltage source provided in the apparatus.

The developing device 5 is disposed relative to the center 0 of the rotary 4 in such positional relation that in terms of the angle from the center of a developing sleeve 51 to the center of another developing sleeve 51, the relative angle between the developing devices 5Y and 5M, between the developing devices 5M and 5C and between the developing devices 5Bk and 5Y is 80° and the relative angle between the developing devices 5C and 5Bk is 120°.

The reason why the angle between the developing devices 5C and 5Bk is wide is that the developing device 5Bk is higher in the frequency of use than the other developing devices 5 and therefore, the toner containing space in the developing device 5Bk or the supply container 11Bk becomes large and the carrying space therefor by the rotary 4 must also be wide as compared with the carrying spaces for the other developing devices 5.

Herein, the arrangements of the developing devices 5 in the rotary 4 are designated by the colors of the toners contained therein, and the Y portion in the rotary 4 refers to the central portion of the developing sleeve 51 of the developing device 5Y. The rotating operation of the rotary 4 is indicated by the color of the toner contained in the developing device 5 disposed at the developing position 50. For example, the description that "80° rotation for Y→M" means that the rotary member 4 has carried out the movement for the rotation by 80° so that the developing device 5 disposed at the developing position 50 may be changed over from the developing device 5Y to the developing device 5M.

The rotary 4 is usually rotated so that the developing devices 5 may be moved to the developing position 50 in the order of Y→M→C→Bk. That is, in the positional relation between the developing rotary 4 and the photosensitive drum 1 shown in FIGS. 5A to 5D of the accompanying drawings, the state is changed in the order of FIGS. 5A, 5B, 5C and 5D. In this example, as will be described later, the state shown in FIG. 5A wherein the developing device 5Y is located at the developing position 50 is defined as the home position (HP), and it is to be understood that when the power source of the image forming apparatus has risen up, the rotary 4 stands by in the state of this HP.

Also, in an image forming apparatus which, as in the above-described construction shown in FIGS. 4 and 9, is provided with a rotary, i.e., a so-called moving member 4 provided with a plurality of developing devices 5 for a single photosensitive drum 1 and in which those developing devices 5 are rotated to thereby successively form toner images on the surface of the photosensitive drum 1, as described, for example, in Japanese Patent No. 3372697 and Japanese Patent Application Laid-open No. H08-114963, as an element for effecting stable image forming, there is the setting of the distance between the photosensitive drum 1 and the developing sleeve 51 of each developing device 5 toward the rotation outer periphery of the rotary 4. Generally, even when the distance between the surface of the photosensitive drum 1 and each developing sleeve 51, i.e., the so-called SD gap is constant and the photosensitive drum 1 and the developing sleeve 51 during image forming are being rotated, the SD gap is made constant without being affected by the vibration thereof, whereby the occurrence of uneven density can be suppressed.

Means most popular as means for relatively easily achieving the condition of making the SD gap constant is, as shown in FIG. 6 of the accompanying drawings, to provide a ramming member (runner) 52 of which the diameter is larger by a set distance in terms of the radial distance relative to the diameter of the developing sleeve coaxially with the developing sleeve 51 and of which the outer peripheral portion and the inner peripheral portion are rotatable independently of each other so that the rotation of the photosensitive drum 1 and the rotation of the developing sleeve 51 may not affect each other. Thereby, at the developing position 50, the developing device 5 is pressed toward the center of rotation of the photosensitive drum 1, and the ramming runner 52 is brought into contact with the shaft flange portion 1*b* of the photosensitive drum 1, whereby the set distance between the surface of the photosensitive drum 1 and the developing sleeve 51, i.e., the SD gap G, is always kept constant without being affected by the vibration due to the rotation. This means does not require to strictly adjust particularly the position of the developing device 5, and exactly the position of the developing sleeve 51, and is simple in construction itself and therefore, can be achieved at a low cost and is widely used not only in the rotary developing apparatuses.

In the image forming apparatus of the intermediate transfer type, in the image forming process, a full-color toner image is usually formed by toner images of four colors, i.e., yellow, magenta, cyan and black being successively superimposed upon one another on the ITB 2*d* in the primary transferring portion T1 which is a portion in which the ITB 2*d* and the photosensitive drum 1 are opposed to each other and in which a primary transfer roller 2*e* is disposed on the back side of the ITB 2*d*. During the time when these toner images of the first color to the fourth colors are primary-transferred onto the ITB 2*d*, the secondary transfer outer roller 7 is spaced apart from the intermediate transfer belt 2*d*.

After the toner images of the four colors have been primary-transferred onto the ITB 2*d*, the secondary transfer outer roller 7 is brought into contact with the ITB 2*d*, and the recording material is nipped by and between this secondary transfer outer roller 7 and the secondary transfer inner roller 2*b* in the secondary transferring portion T2 with the ITB 2*d* interposed therebetween, and a secondary transferring bias is applied from the secondary transfer outer roller 7 to the back side of the recording material, whereby the toner images of the four colors on the ITB 2*d* are collectively secondary-transferred onto the recording material.

However, when color image forming is carried out in the image forming apparatus using the above-described rotary developing apparatus as shown in FIGS. 4 and 9, exposure and developing are effected for each color and therefore, even in a case where exposure is effected at ideal positions aligned at equal distances on the drum 1, position misregister occurs for each of Y, M, C and Bk during primary transfer, and the position misregister between the colors is recognized as color misregister.

That is, until the color toner images are primary-transferred to the intermediate transfer belt 2*d* from the start of the image forming, each image forming process is carried out discretely for each color. Consequently, the rotary 4, when the developing of the toner image of the first color, i.e., yellow is finished, is rotated to thereby change over the developing device 5 located at the developing position 50 from the yellow developing device 5Y to the magenta developing device 5M in order to form the next magenta toner image. In the meantime, the photosensitive drum 1 is also rotated and the yellow toner image on the surface thereof is also moved from the developing position 50, and when it has arrived at the primary transferring portion T1 opposed to the intermediate transfer belt 2*d*, primary transfer is effected.

When at this time, the primary transfer is effected during the rotation of the rotary 4, the ramming runner 52 of the developing device 5 comes into contact with the drum 1, and color misregister occurs due to the contact shock thereof.

Further, by the intermediate transferring process being adopted, even when the primary transfer is effected at the ideal positions aligned at equal intervals on the ITB 2*d*, position misregister occurs during secondary transfer and the interval is recognized as non-uniform pitch misregister.

In ordinary images, color misregister is the misregister of adjacent or overlapping colors and therefore tends to be recognized as a faulty image. On the other hand, pitch misregister, except in equal pitch images uniform in density, tends to be difficult to be recognized as a faulty image.

That is, color misregister is considered to be apt to occur if the timing at which an image of each color is formed on the photosensitive drum 1, i.e., the timing (contact timing) at which the rotary 4 changes over the developing device 5 located at the developing position 50, the timing for primary transfer and the timing for secondary transfer overlap one another.

The control of the rotation of the rotary 4 which is a developing device changeover mechanism in the image forming apparatus of the above-described construction will be described here with reference to FIG. 10 of the accompanying drawings. The rotary 4 is provided with a flag (not shown) and is designed to be rotatively moved with the flag with the rotation of a rotary motor 41. Also, an apparatus main body is provided with a home position detecting sensor 42 for detecting the rotated position of the rotary 4, and this sensor 42 is disposed so as to detect the flag provided on the rotary 4.

When a central control board 100 recognizes that the power supply switch of the apparatus has been closed, a motor table signal is sent to a motor rotation control board 43 provided in the control mechanism of the apparatus, and the rotary 4 starts its rotating operation by the rotary motor 41. When subsequently, the signal of the home position detecting sensor 42 is detected, the motor rotation control board 43 stops the motor 41 to thereby stop the rotation of the rotary 4, and makes it stand by at the home position (HP) indicated in FIG. 5A. It is to be understood here that the HP is a state in which the yellow developing device 5Y has been disposed at the developing position 50 which is a position at which it contacts with the drum 1.

Then, when the central control board (control means) 100 of the control mechanism of the apparatus recognizes that a copy start button has been depressed, that is, an image forming signal has been transmitted, the motor 41 is rotated on the basis of two kinds of motor tables 44 (44*e*, 44*f*) shown in FIG. 13 of the accompanying drawings which will be described below.

The axis of coordinates in FIG. 13 corresponds to the number of revolutions of the motor 41, i.e., the rotational speed of the rotary 4, and the axis of abscissas indicates the rotational time of the motor 41 in which the time when the motor 41 is started is 0. In the motor tables 44 (44*e*, 44*f* used for the control of the rotation of the rotary 4 at this time, a table 44*f* (solid line in FIG. 13) is used during the 120° movement of C→Bk when the color of the toner image to be formed is changed over, and a table 44*e* (dotted line in FIG. 13) is used during the 80° movement of Y→M, M→C and Bk→Y (HP). The acceleration/deceleration curves shown in these two tables effect the shortening of the moving time as a maximum value at which the motor 41 does not lose synchronism, and the rotational speed of the rotary 4 is equivalent and the moving time differs. That is, control is effected so that irrespective of the rotated distance, the number of revolution may be increased to the same speed, and when the rotary is rotated by 120°, the rotary may be rotated for a longer time than when it is rotated by 80°.

The timing at which the rotary 4 is rotated is set in connection with the image forming process such as exposure, primary transfer and secondary transfer, in accordance with an operation sequence shown in FIG. 14 of the accompanying drawings.

First, a laser beam is emitted to the exposing position 30 (see FIG. 4) of the drum 1 on the basis of yellow (Y) image information, and a Y latent image is formed on the drum (timing Y1 in FIG. 14). The Y latent image is moved to the developing position 50 provided downstream of the exposing position 30 with respect to the direction of rotation of the drum 1, and the Y toner is applied to the drum 1 by the Y developing device 5Y. Further, the Y toner image is moved to the primary transferring position T1 provided downstream of the developing position 50 with respect to the direction of rotation of the drum 1, and is primary-transferred onto the ITB 2*d* by the primary transfer roller 2*e* (timing Y2 in FIG. 14).

Here, the timing RI (HP→Y), R2 (Y→M), R3 (M→C), R4 (C→Bk) and R5 (Bk→HP) of the rotation of the rotary 4 are designed to precede the exposure timing Y1, M1, C1 and Bk1 of the respective colors without fail, and when the developing step is executed, a desired latent image is formed on the surface of the photosensitive drum 1 without fail, and when the electrostatic image on the photosensitive drum 1 has come to the developing position 50, a desired developing device 5 comes to stand by earlier at the developing position 50 without fail. That position is ensured by the aforementioned contacting member 52.

However, since the transferring position T1 is located downstream of the exposing position 30 with respect to the direction of rotation of the drum 1, much time is required from after exposure has been done until the primary transfer is effected and therefore, it is impossible to change over the timing of the exposure and the timing of the primary transfer at a time and accordingly, the exposure and the primary transfer become operation sequences differing in timing from each other. That is, M image forming begins before the primary transferring step of the Y toner image ends. That is, when Y developing is terminated later than the termination of Y exposing (timing Y1), the rotary 4 starts its rotation and the Y→M rotation timing R2 of the rotary 4 comes, and the changeover from the Y developing device 5Y to the M developing device 5M at the developing position 50 is effected. In the meantime, M exposing (timing M1) is not started, but yet Y primary transfer (timing Y2) still continues and therefore, the influence of the rotation of the rotary 4 does not appear, but yet appears in the Y primary transfer.

The afore-described operation is repeated, whereby Y, M, C and Bk are multiplexly transferred onto the ITB 2*d*. The multiplexly transferred images on the ITB 2*d* are moved to the secondary transferring position T2 provided downstream of the primary transferring position T1 with respect to the direction of rotation of the ITB 2*d*, and are secondary transferred to a recording material conveyed in synchronism with the multiplexly transferred images, by secondary transfer rollers 2*b* and 7. When Bk developing is terminated later than the termination of Bk exposing (timing Bk1), the rotary 4 starts its rotation (timing R5), and the changeover from the Bk developing device 5Bk to the Y developing device 5Y is effected. In the meantime, the secondary transfer (timing X) continues and therefore, the influence of the rotation of the rotary 4 also appears in the secondary transfer.

As described above with reference to FIG. 14, the operation timing Y2, M2, C2 and Bk or secondary transfer timing X of the primary transfer of the respective colors overlap the rotation timing R2 (Y→M), R3 (M→C), R4 (C→Bk) and R5 (Bk→Y), respectively, of the rotary 4.

The rotary rotation timing R2 to the primary transfer timing Y2, M2, C2 and Bk2 differs in the timing affected from the timing R4 of the 120° movement of C→Bk depending on the positions of the developing devices 5 in the rotary 4 because at the timing R2, R3 and R5 of the 80° movement of Y→M, M→C and Bk→Y (HP), the rotational speed of the rotary 4 is the same as can be seen from the table 44 shown in FIG. 13 and the time required for changeover differs.

The kinds of the faulty image due to such changeover of the rotary will now be described with reference to FIGS. 15A to 15D of the accompanying drawings. For a color image, exposure and developing are effected for each color. FIGS. 15A to 15D enlarge image portions formed in the image forming processes of the respective colors, and typically show the positional relations thereof in a latent image state, a primary transfer state and a secondary transfer state. Accordingly, even when as in the latent image state shown in FIG. 15A, exposure has been effected at ideal positions aligned at equal intervals on the drum 1, Y, M, C and Bk are not formed at the same position during the primary transfer, like primary-transferred images shown in FIG. 15B, but position misregister occurs for each color, and the position misregister among the colors is recognized as color misregister.

Also, even when the color misregister as shown in FIG. 15B can be avoided and as shown in FIG. 15C, primary transfer has been effected at the ideal positions aligned at equal intervals on the ITB 2*d*, the respective colors are formed at the same position, like the secondary-transferred images shown in FIG. 15D, and therefore, color misregister does not occur, but yet during the secondary transfer, the position misregister in which the formed positions thereof themselves deviate from the ideal positions, and as pitch misregister which is non-uniform in the positional interval of formed images between the images, the position misregister is recognized in the enlarged images as shown.

In the ordinary images, color misregister is the misregister of adjacent or overlapping colors and therefore tends to be recognized as a faulty image. On the other hand, pitch misregister tends to be difficult to be recognized as a fault image except in equal pitch images uniform in density, unless they are such enlarged images as shown in FIGS. 15A to 15D.

The phenomena of position misregister and color misregister due to the rotational shock of the rotary which are shown in FIGS. 15A to 15D will be further described with reference to FIGS. 16A to 16C of the accompanying drawings. When as previously described, the control of the rotation of the rotary 4 is effected in accordance with the operation sequence of FIG. 14, the position misregister on the photosensitive drum 1 shown in FIG. 16A is caused by the shock with which the ramming runner 52 of the developing device 5 contacts with the drum 1 during the primary transfer. In FIGS. 16A, 16B and 16C, the number of lines indicates the image position, and 0 is the head and 74 is the trailing edge of the image. As previously described, the rotating operation time between C→Bk of the rotary 4 is long and therefore, the position misregister of the C image occurs in the vicinity of 72 lines, and along therewith, the position misregister of Y, M and Bk images occurs from the vicinity of 68 lines to the trailing edge of the image.

With C at this time as a reference color, color misregister from C is shown in FIG. 16B. Here, under the influence of the position misregister of the Y, M and Bk images, minus color misregister occurs in the vicinity of 68 lines, and under the influence of the position misregister of the C reference color, plus color misregister occurs in the vicinity of 72 lines.

A maximum color misregister amount occurring to the images on the ITB 2*d* is shown in FIG. 16C. Here, Bk position-misregisters toward the leading edge side of the image relative to the C reference color, and the color misregister amount thereof is minus, and M position-misregisters toward the trailing edge side of the image and the color misregister amount thereof is plus. Therefore, a greater color misregister amount occurs between Bk-M than between Bk-C and between M-C. According to this, the maximum color misregister amount occurring to the images is 0.14.

The developing device changeover operation by the rotary 4 is thus performed when the other image forming steps are being executed, whereby color misregister occurs, but to achieve an improvement in the productivity of the image forming apparatus, it is necessary to effect the changeover of the developing device during image forming, and the following inconveniences 1, 2 and 3 are apt to occur due to the shock the ramming runner 52 of the developing device 5 gives to the photosensitive drum 1.

Inconvenience 1: When during latent image forming, the ramming runner 52 contacts with the photosensitive drum 1, the uneven exposure of the latent image depicted on the surface of the photosensitive drum 1 poses a problem.

Inconvenience 2: When during primary transfer, the ramming runner 52 contacts with the photosensitive drum 1, the uneven transfer of the toner image of each color transferred to the ITB 2*d* poses a problem.

Inconvenience 3: When during secondary transfer, the ramming roller 52 contacts with the photosensitive drum 1, the uneven transfer of the multiplex image transferred to the recording material poses a problem.

The inconvenience 1 is avoided by setting the changeover timing of the developing device 5 by the rotary 4 so as not to coincide with the exposure timing.

Also, a flywheel is mounted on the driving shaft of the photosensitive drum 1 to thereby avoid the inconvenience 2, and the rigidity of the ITB unit 2 and the frame member 2*f* is enhanced to thereby avoid the inconvenience 3, but a certain degree of cost load is unavoidable.

Also, the functional unification of a color copying machine and a black-and-white copying machine has been advanced, and the amount of black toner is remarkably greater than the amounts of yellow, magenta and cyan toners, and the arrangement of the developing devices 5 in the rotary 4 is liable to become asymmetric. Thereby, the following inconvenience 4 arises.

Inconvenience 4: The positions at which the faulty images of the inconveniences 1 and 2 differ among the colors.

Due to this inconvenience 4, the position misregister among the colors is actualized and therefore the faulty image by color misregister poses a problem even if a conventional avoidance countermeasure for reducing the shock amount is taken.

SUMMARY OF THE INVENTION

So, it is an object of the present invention to provide an image forming apparatus having a construction changing over and using a plurality of developing devices and which does not cause color misregister in spite of a construction in which the moving distances of developing devices during the changeover thereof differ from one developing device to another.

A preferred image forming apparatus for achieving the above object has:

an electrostatic image forming device for forming an electrostatic image on an image bearing member;

a plurality of developing devices, each having a different color developer for developing the electrostatic image on the image bearing member at a developing position;

a moving member holding the plurality of developing devices for selectively moving the plurality of developing devices to the developing position;

a controller for controlling a movement of the moving member to successively move a plurality of developing devices to the developing position in an image forming operation, wherein a the moving distance in at least one moving operation is different from a moving distance in a plurality of moving operations;

a primary transferring device for successively transferring each developer image formed by each developing device moved to the developing position onto an intermediate transfer member in a primary transfer position in a superimposing manner; and a secondary transferring means for transferring developer images, which have been transferred on the intermediate transfer member in the superimposing manner onto a recording material conveyed to a secondary transfer position.

wherein the controller performs the at least one moving operation and some moving operations of the other moving operators during the transfer operation by the primary transferring device, and wherein the controller controls a moving speed of the moving member so that a relative position of a trailing edge of an image forming region on the image bearing member with respect to the developing position when the at least one moving operation is completed and the relative position of the trailing edge of the image forming region on the image bearing member with respect to the developing position when the some moving operations are completed become substantially equal to each other.

DESCRIPTION OF THE PREFERRED EMBODIMENTS

A developing apparatus according to the present invention will hereinafter be described in greater detail. However, the dimensions, materials, shapes, relative arrangement, and so on, of constituent parts described herein are not intended to restrict the scope of this invention thereto unless particularly specified.

First Embodiment

Figure 6:
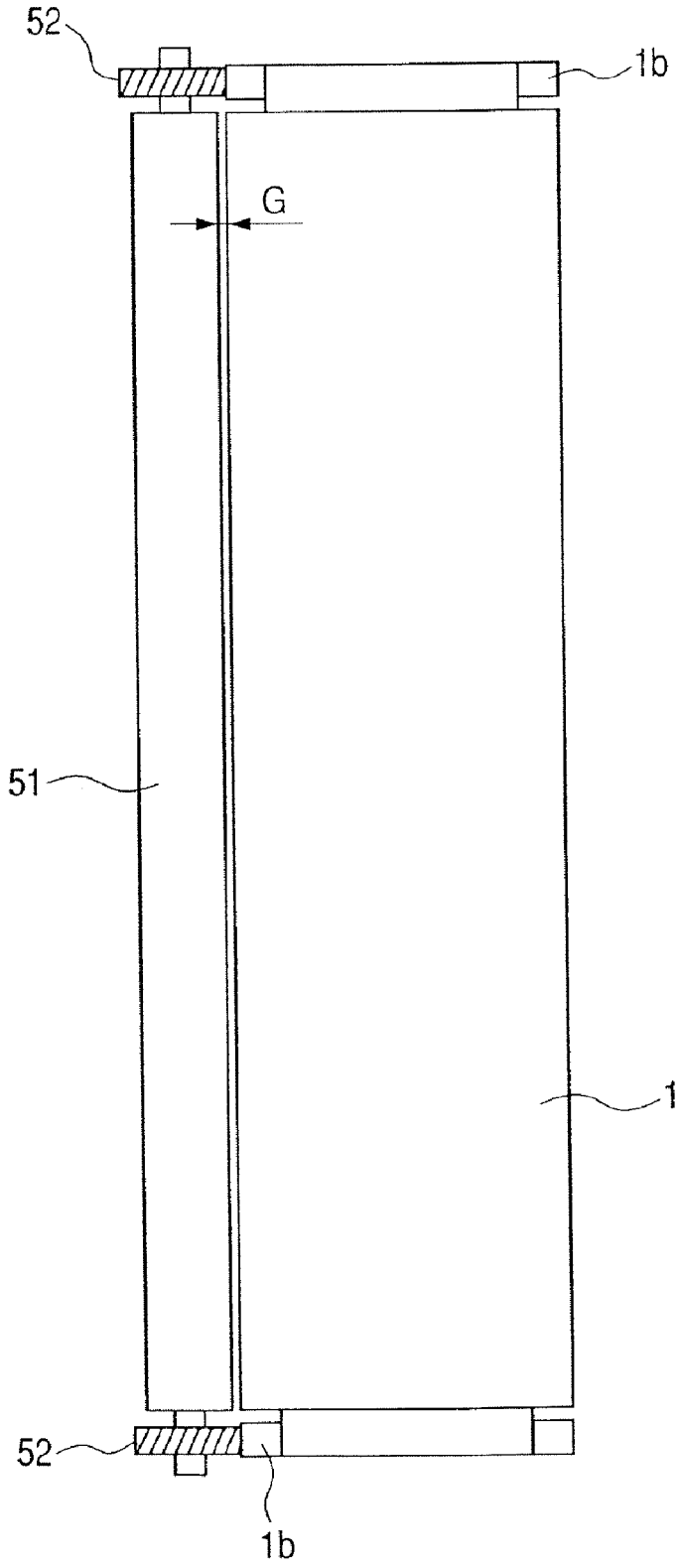
FIG. 6 is a view schematically showing the construction of the periphery of a contacting member in an example of a developing apparatus according to the present invention.
Figure 9:
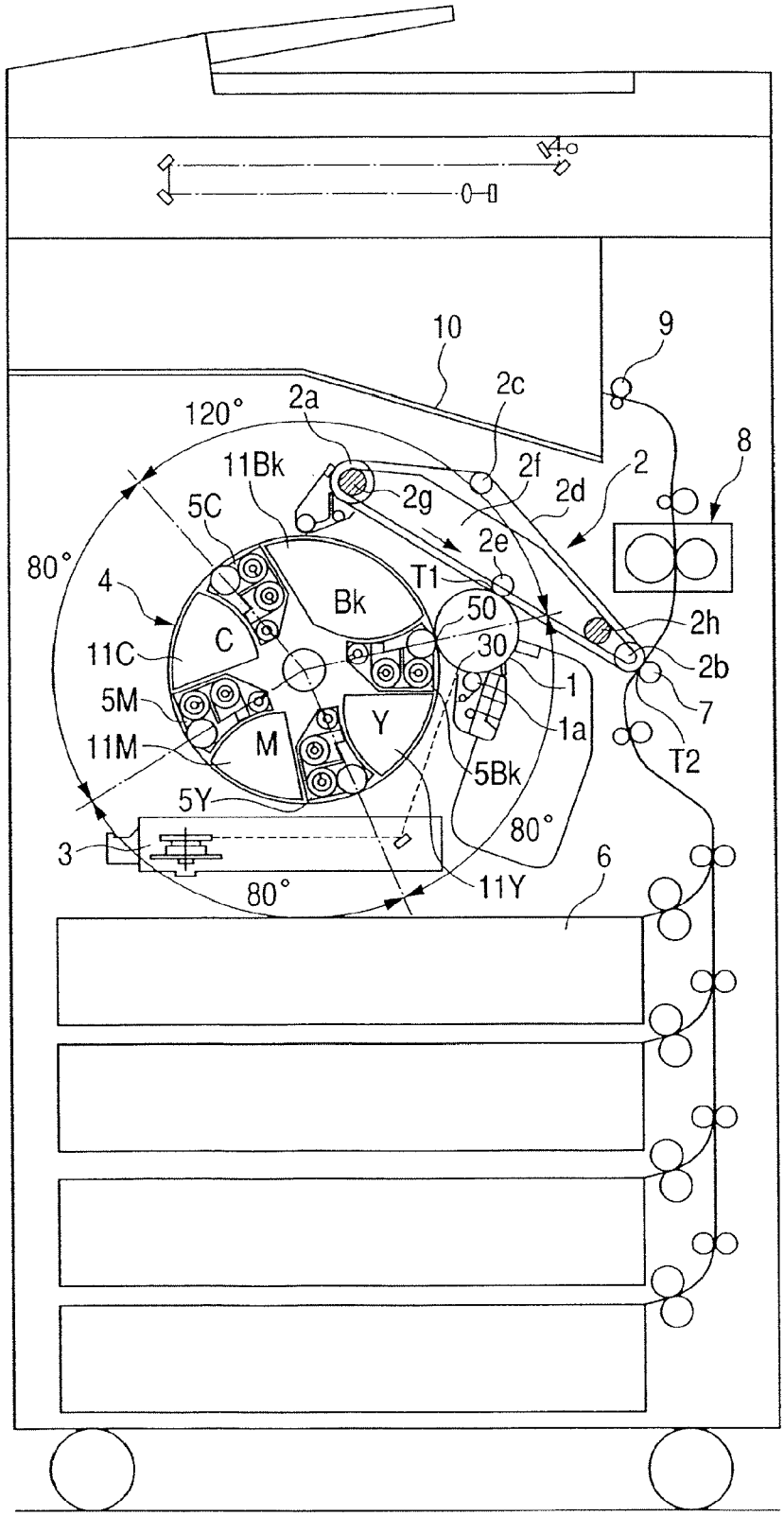
FIG. 9 is a view schematically showing the construction of an example of the image forming apparatus according to the present invention.

An image forming apparatus provided with the developing apparatus used in this embodiment is similar to the image forming apparatus described in the example of the conventional art with reference to FIG. 9 in the general construction thereof and the construction of the ramming runner 52 of the developing device shown in FIG. 6 and therefore, those constructions need not be described in detail again.

Figure 10:
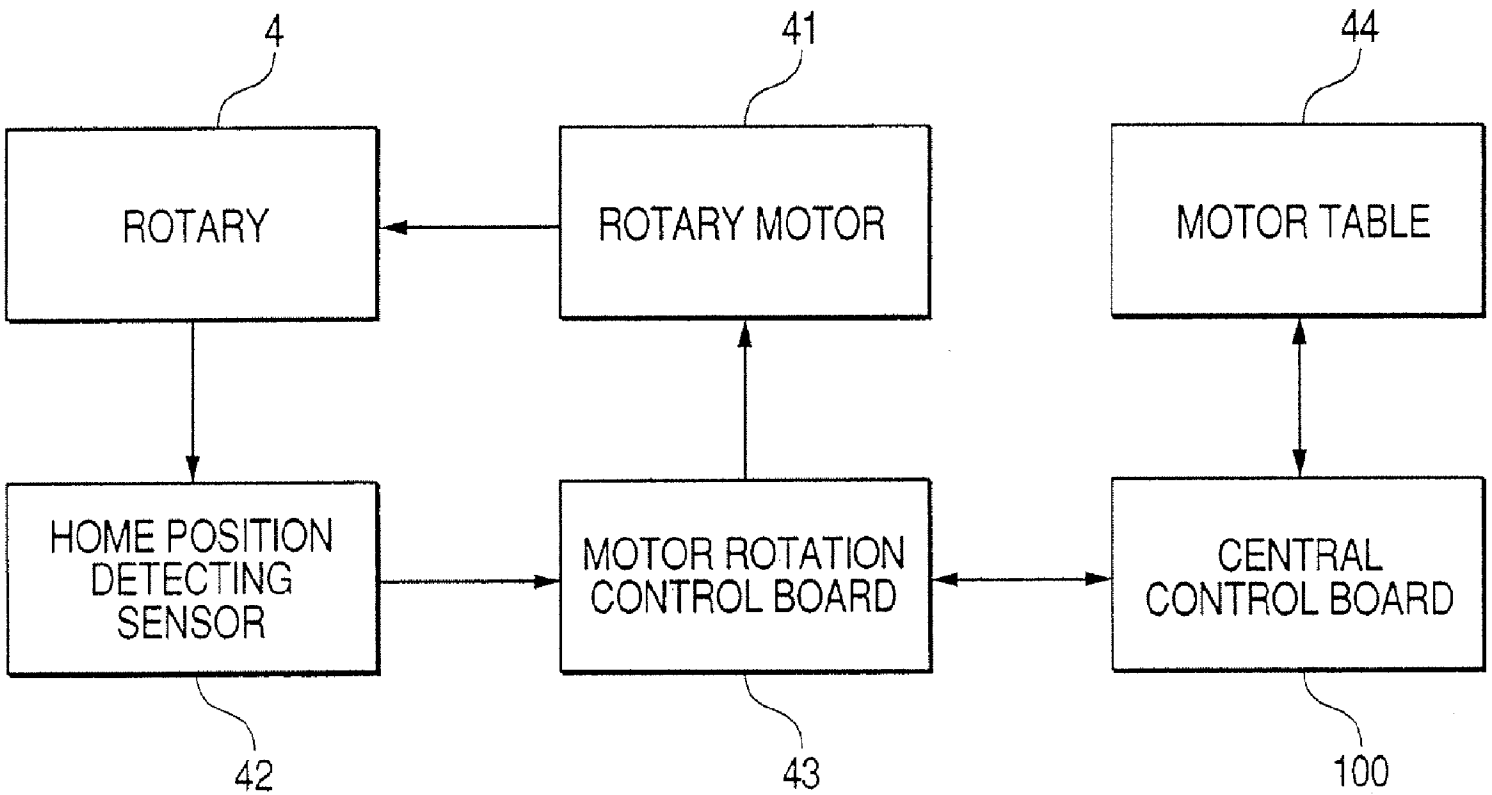
FIG. 10 is a block diagram showing the operation of the changing means according to the present invention.

A description will first be made of the control of the rotation of a moving member (rotary) 4 which is a developing device changeover mechanism which is a characteristic portion of the present embodiment. The controlling operation until the image forming process described in the example of the conventional art is started, that is, until an image signal is transmitted, or in the present embodiment, until a copy button is depressed, is similar to that in the example of the conventional art described with reference to FIG. 10. That is, the rotary 4 is provided with a flag (not shown) and as a rotary developing apparatus, it is designed to be rotatively moved with the flag with the rotation of a rotary motor 41, and an apparatus main body is provided with a home position detecting sensor 42 for detecting the rotated position of the rotary 4, and this sensor 42 is disposed so as to detect the flag provided on the rotary 4, and when a central control board 100 recognizes that the power supply switch of the apparatus has been closed, a motor table signal is transmitted to a motor rotation control board 43, whereby the rotary motor 41 starts its rotating operation. When subsequently, a Y developing device 5Y is disposed at a home position HP disposed at a developing position, this fact is detected by the home position detecting sensor 42, and the motor rotation control board 43 stops the motor 41 and the Y developing device 5Y stands by at the home position HP.

Figure 1:
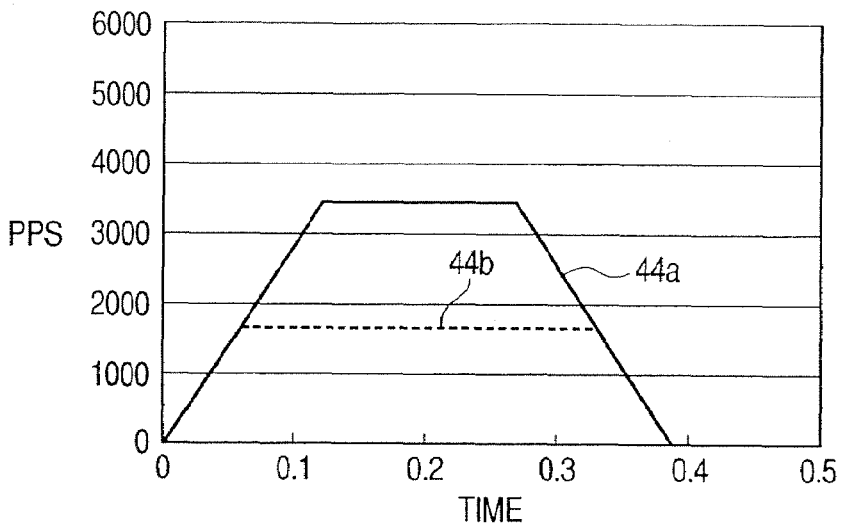
FIG. 1 is a motor table showing an example of changing means according to the present invention.

When the central control board 100 of an apparatus control mechanism recognizes that a copy start button has been depressed, that is, an image forming signal has been transmitted, the rotary 4 is rotated on the basis of motor tables 44 (44*a*, 44*b*), but the present embodiment has changing means for changing the moving speed of the rotary 4 by the moving distance of each developing device 5 to the developing position 50, and as what constitutes the changing means, use is made of the motor tables 44*a* and 44*b* shown in FIG. 1.

Of these motor tables 44 (44*a*, 44*b*) used for the control of the rotation of the rotary, the table 44*a* is for the 120° movement of C→Bk, and the table 44*b* is for the 80° movement of Y→M, M→C and Bk→Y (HP). That is, the two tables 44*a* and 44*b*, i.e., acceleration and deceleration curves, are similar to each other, and have effected the shortening of the moving time as a maximum value at which the motor 41 does not lose synchronism. The table 44*a* used in the rotation of a long moving distance makes the rotational speed of the rotary 4 higher than the table 44*b*, that is, makes the rotational speed different, and makes the moving time equivalent, whereby there has been effected such control that the time for each developing device 5 to be moved from a developing standby position which is a position just preceding the developing position 50 to the developing position P is made the same.

Figure 2:
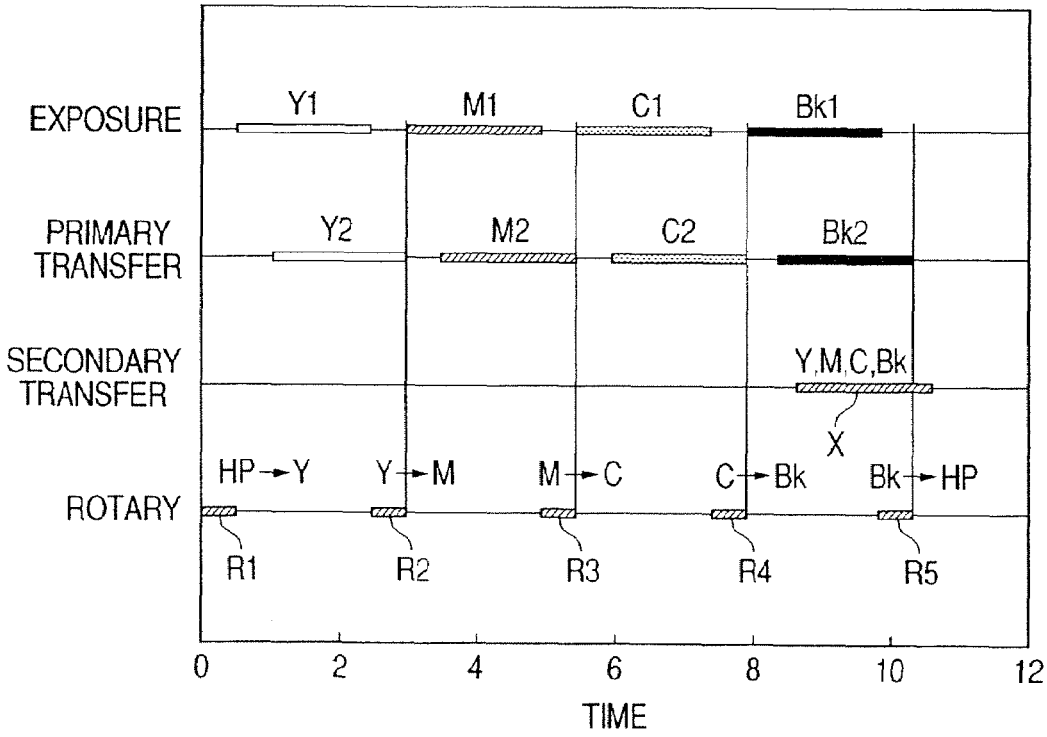
FIG. 2 is a timing chart showing an example of an operation sequence in an image forming process according to the present invention.

The timing at which the rotary 4 is rotated is set in connection with the image forming steps such as exposure, primary transfer and secondary transfer in accordance with an operation sequence shown in FIG. 2.

Referring to FIGS. 4 and 5A to 5D, a laser beam is first emitted to the exposing position 30 (see FIG. 4) of a photosensitive drum 1 on the basis of Y image information (timing Y1), whereby a Y latent image is formed on the drum 1. The Y latent image is moved to the developing position 50 provided downstream of the exposing position 30 with respect to the direction of rotation of the drum 1, and a Y toner is applied to the drum 1 by the Y developing device 5Y. Further, a Y developer image (toner image) is moved to a primary transferring position T1 provided downstream of the developing position 50 with respect to the direction of rotation of the drum 1, and is primary-transferred onto an ITB 2*d* by a primary transfer roller 2*e* (timing Y2);

Here again, much time is required from after the exposure till the primary transfer and therefore, it is impossible to change over the timing of exposure and the timing of primary transfer at a time and accordingly, the exposure and the primary transfer become operation sequences differing in timing from each other. When Y developing is terminated later than Y exposure (timing Y1), the rotary 4 starts its rotation (timing R2), and at the developing position 50, changeover from the Y developing device 5Y to an M developing device 5M (Y→M) is effected. In the meantime, the exposure of M (timing M1) is not started, but yet the primary transfer of Y (timing Y2) still continues and therefore, the influence of the contact (contact shock) of the rotary 4 with the photosensitive drum 1 at timing R1 does not appear in the exposure, but yet appears in the primary transfer at the timing Y2.

The afore-described operation is repeated, whereby Y, M, C and Bk are multiplexly transferred onto the ITB 2*d*. In FIG. 2, parts designated by Y1, M1, C1, and Bk1 in the exposure portion represent respective image forming regions on the photosensitive drum 1 (image bearing member). Then, electrostatic images corresponding to the respective colors of Y, M, C, and Bk are formed within the respective image forming regions. The multiplexly transferred images on the ITB 2*d* are moved to a secondary transferring position T2 provided downstream of the primary transfeffing position T1 with respect to the direction of rotation of the ITB 2*d*, and are secondary-transferred to a recording material conveyed in synchronism with the multiplexed transferred images, by a secondary transfer roller 7 (timing X).

When Bk developing is terminated later than Bk exposure (timing Bk1), the rotary 4 starts its rotation, and changeover from a Bk developing device 5Bk to the Y developing device SY is effected (timing R5).

In the meantime, the secondary transfer (timing X) continues and therefore, the influence of the rotation of the rotary 4 (timing R5) also appears in the secondary transfer (timing X). Also, in the primary transfer (timing Y2, timing M2, timing C2, timing Bk2), all the timing R1, R2, R3 and R4 of the rotation of the rotary 4 which affect become the same in the 120° movement of C→Bk and the 80° movement of Y→M, M→C and Bk→Y (HP).

Figure 3A:
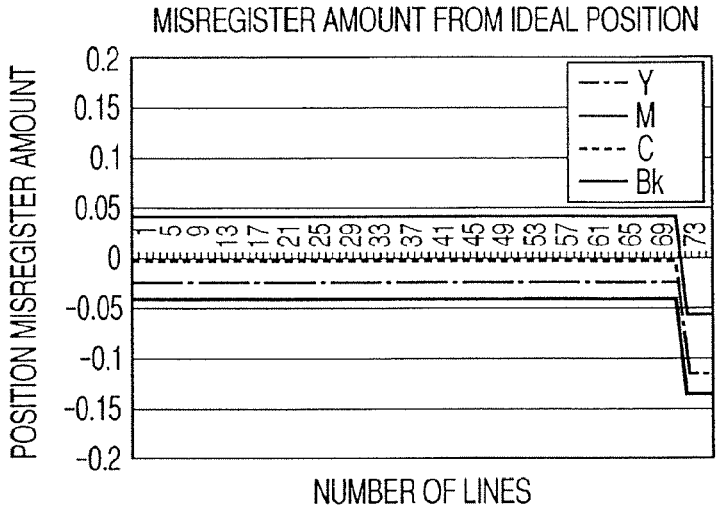
FIGS. 3A, 3B and 3C are illustrations showing color misregister amounts at an image position according to the present invention.

The rotary contact shock and the phenomena of position misregister and color misregister occurring from the above-described operation will be described here with reference to FIGS. 3A to 3C.

As previously described, when the control of the rotation of the rotary 4 is effected in accordance with the operation sequence shown in FIG. 2, position misregister occurs due to the shock with which the ramming runner 52 of the developing device 5 contacts with the drum 1 during primary transfer. In the present embodiment, the position misregister is such as shown in FIG. 3A. In FIGS. 3A, 3B and 3C, the number of lines indicates an image position, and 0 is the head and 74 is the trailing edge of the image. That is, in the present embodiment, the rotating operation time of the rotary 4 is equivalent for the respective colors and therefore, all of the position misregister of Y, M, C and Bk images occur in the vicinity of 72 lines.

Figure 3B:
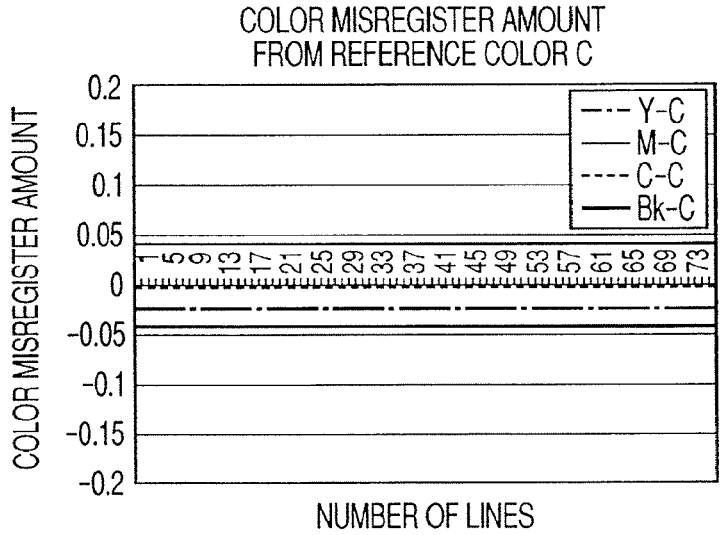

The color misregister from the C reference color at this time is shown in FIG. 3B. The influence of the position misregister of Y, M, C and Bk images (color misregister occurs) is offset by the influence of the position misregister of the C reference color and no color misregister occurs.

Figure 3C:
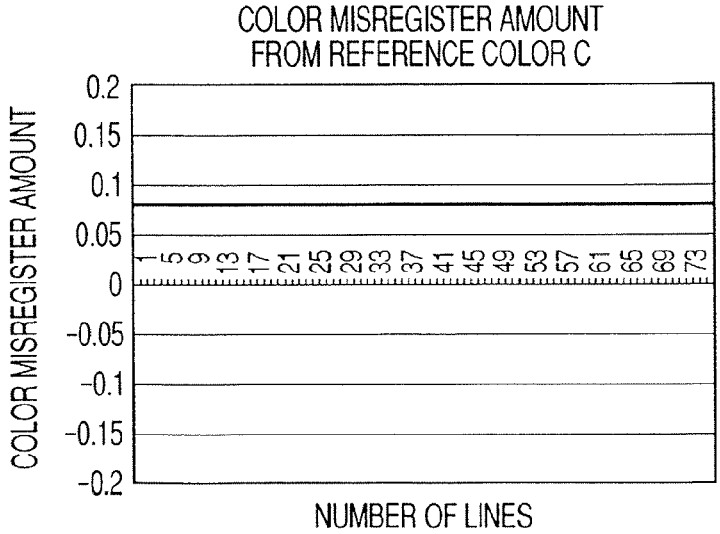

A maximum color misregister amount occurring to the images on the ITB is shown in FIG. 3C. Here, relative to the C reference color, Bk position-misregisters toward the leading edge side of the images, and the color misregister amount is minus, and M position-misregisters toward the trailing edge side of the images, and the color misregister amount is plus. Therefore, the color-misregister amount becomes greater between Bk-M than between Bk-C and between M-C. According to this, the maximum color misregister amount occurring to the images is 0.08, and has decreased to about a half as compared with the conventional art in which the speed was made constant in spite of the moving distance of the developing device 5.

As described above, the rotating time of the rotary 4 for each color is made equivalent, whereby the position misregister occurring position to the images is adjusted, whereby color misregister can be prevented.

Second Embodiment

As another form of the present embodiment a description will be made of a form in which the motor tables 44 used in the control of the rotation of the rotary 4 which is the developing device changeover mechanism are changed over in accordance with an operation mode.

An image forming apparatus used in the present embodiment is similar to the image forming apparatus used in the first embodiment except for the motor tables 44 and therefore need not be described.

The mode in which the control of the rotation of the rotary 4 according to the present embodiment is required is divided broadly into three modes, i.e., (1) an ordinary color image forming mode, (2) a toner supplying mode and (3) an image adjusting mode. In the first embodiment, the motor tables 44*a* and 44*b* shown in FIG. 1 are used for the control of the rotation of the rotary 4 in these modes (1), (2) and (3).

Figure 7:
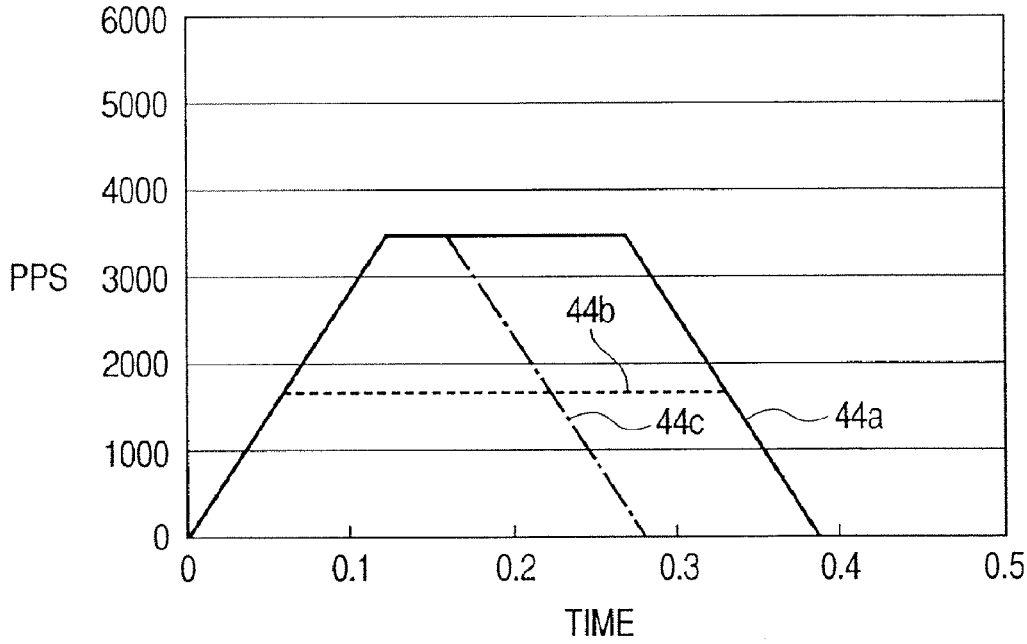
FIG. 7 is a motor table showing another example of the changing means according to the present invention.

In the present embodiment, for the further stabilization of the toner supply, different motor tables 44 are used in (1) the image forming mode, (2) the toner supplying mode and (3) the image adjusting mode. Here again, in (1) the image forming mode, such motor tables 44*a* and 44*b* as shown in FIGS. 1 and 7 are used for the control of the rotation of the rotary 4 to thereby prevent color misregister. In (2) the toner supplying mode and (3) the image adjusting mode, however, use is made of such motor tables 44*a* (solid line) and 44*c* (dot-and-dash line) as shown in FIG. 7 wherein the rotational speed of the rotary 4 is equivalent. The motor table 44*c* is used during the 80° movement of Y→M, M→C and Bk→Y (HP) in which the moving distance is short, and the motor table 44*a* is used during the 120° movement of C→Bk in which the moving distance is long.

The present image forming apparatus effects the toner supply by the rotation of the rotary 4 for image forming. When at this time, high density images have been continuously copied, the copying is discontinued and the toner supplying sequence by the idle rotation control of the rotary 4 is executed. In (2) the toner supplying mode, the purpose is to fill the developing device 5 with a toner from a supplying container 11 by the rotation of the rotary 4 and image forming is not carried out and therefore, color misregister need not be taken into consideration. The rotation of the rotary 4 during the toner supply is made equal in speed, whereby a stable toner supply can be realized. Usually the toner supply is satisfied by several full idle rotations and copying is resumed.

Figure 11A:
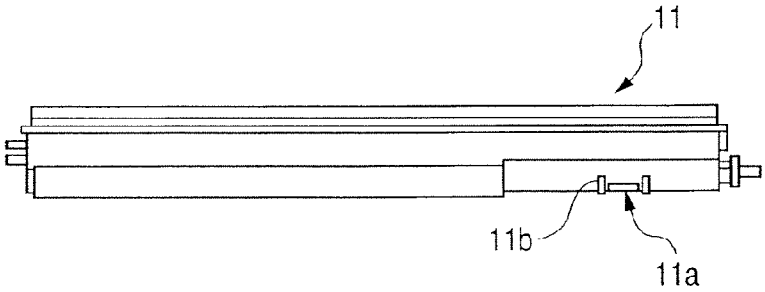
FIGS. 11A, 11B, 11C, 11D and 11E are views schematically showing the construction of an example of a developer supplying container according to the present invention.
Figure 11B:
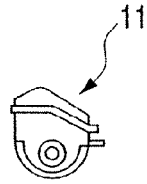
Figure 11C:
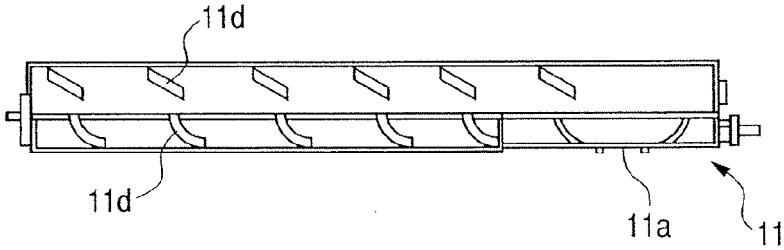
Figure 11D:
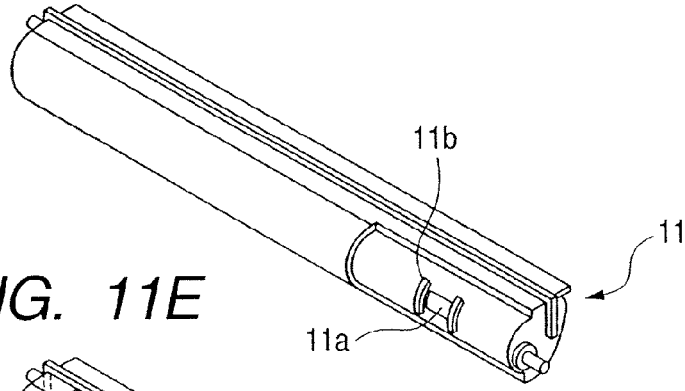
Figure 11E:
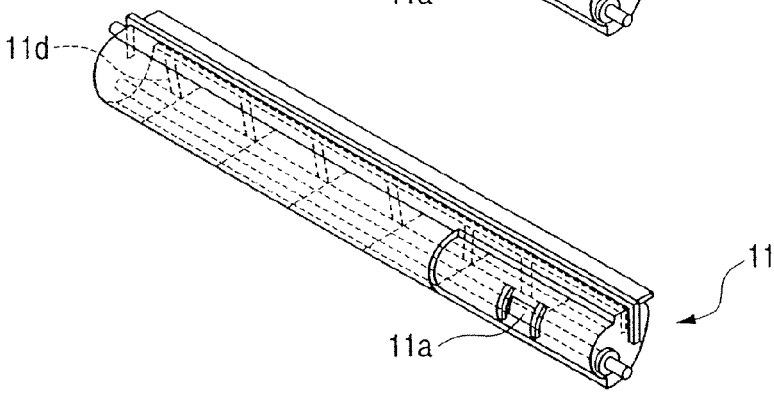

FIG. 11A is a front view of a supplying container body 11 provided in the rotary 4 together with the developing devices 5, FIG. 11B is a side view thereof, FIG. 11C is a front cross-sectional view thereof, FIG. 11D is a perspective view thereof, and FIG. 11E is a perspective see-through view thereof. The container body 11 is provided with a developer discharge opening 11*a*, a shutter guide 11*b* and carrying projections 11*d*.

The discharge opening 11*a* as an opening portion is a rectangle of 10 mm×15 mm, and is formed in the peripheral surface of the container 11 at a location of 40 mm from the end surface of the container 11. The developer contained in the container body 11 is discharged to the developing device 5 through the discharge opening 11*a*. By the discharge opening 11*a* being formed in the peripheral surface of the container body 11, the residual developer amount residual in the developer supplying container 11 after discharge can be made small, as compared with a developer supplying container provided with an opening portion in the end surface of the container body 11. Also, the discharge opening 11*a* can be made shorter than the full length of the container body 11 in the longitudinal direction thereof to thereby reduce the stains by the adherence of the developer.

The shutter guide 11*b* comprises two hook-shaped ribs provided near the developer discharge opening 11*a* of the container body 11 and parallel with the circumferential direction thereof a shutter (not shown) engageable with this shutter guide 11*b* is mounted for reciprocal movement in the circumferential direction.

In the interior of the container body 11, the carrying projections 11*d* for carrying the contained developer to the discharge opening 11*a* are spaced apart from each other and protrudedly provided on the inner wall of the container body 11. The carrying projections 11*d* are provided while being divided into two upper and lower groups spaced apart circumferentially of the container body 11. In the present embodiment, the height of the projections is 5 mm and the thickness thereof is 1 mm. The height of the carrying projections 11*d* on the small-diametered portion of the container body 11 which is adjacent to the discharge opening 11*a* is 2.5 mm, and six projections and seven projections are provided on the upper portion and lower portion, respectively, of the container body 11. By the carrying projections 11*d* being thus provided while being divided into two upper and lower groups circumferentially spaced apart from each other, the developer can be effectively loosened by the spacing-apart portion between adjacent ones of the projections, and the developer can be smoothly discharged through the discharge opening 11*a*.

Also, the container body 11 can be manufactured by molding what has been divided into two upper and lower parts, and adhesively securing the two to each other, and the container body 11 can be shaped and manufactured by a minimum number of divisions and as a result, it can be manufactured inexpensively.

The container body 11 is filled with a predetermined amount of developer and is mounted on the rotary 4 and unsealed by the aforedescribed procedure. In the process of image forming, the developer in the developing device 5 is gradually consumed, but design is made such that the developer is sent into the developing device 5 by a signal from means (not shown) for detecting the developer amount in the developing device 5 or the ratio between the developer and carrier, and by the action of the carrying projections lid in the container 11, and the developer amount in the developing device 5 or the ratio between the developer and carrier is kept substantially constant.

Design is made such that at the developing position 50, the developing device 5 is operated, whereby the developer in the developing device 5 is decreased near the connected portion to the discharge opening 11*a* of the developer supplying container 11. The developer supplying container 11 is designed to communicate with a developer receiving port (not shown) on the developing device 5 side. Therefore, if the developer in the developing device 5 is decreased, the developer present in the end portion of the developer supplying container 11 will immediately fall from gravity and be supplied to the developing device 5 through the discharge opening 11*a*.

Thus, in the rotation of the rotary 4 for the toner supply, use is made of the motor tables 44*a* and 44*c* in which the rotational speed of the rotary 4 is equivalent, whereby a quick and stable toner supply is obtained.

Third Embodiment

As another form of the present embodiment, description will now be made of a form in which the motor tables 44 used for the control of the rotation of the rotary 4 which is the developing device changeover mechanism are changed over in accordance with the operation mode.

An image forming apparatus used in the present embodiment is similar to the image forming apparatus used in the first and second embodiments, except for the motor tables 44, and therefore need not be described.

The situation in which the control of the rotation of the rotary 4 is required is divided broadly into three modes, i.e, (1) the ordinary color image forming mode, (2) the toner supplying mode and (3) the image adjusting mode, as described above. In the first embodiment, the motor tables 44*a* and 44*b* shown in FIG. 1 are used for the control of the rotation of the rotary 4 in the modes (1), (2) and (3). Also, in the second embodiment, the motor tables 44*a* and 44*b* shown in FIG. 1 are used for the control of the rotation of the rotary 4 in the modes (1) and (3), and the motor tables 44*a* and 44*c* shown in FIG. 7 are used for the control of the rotation of the rotary 4 in the mode (2).

Figure 8:
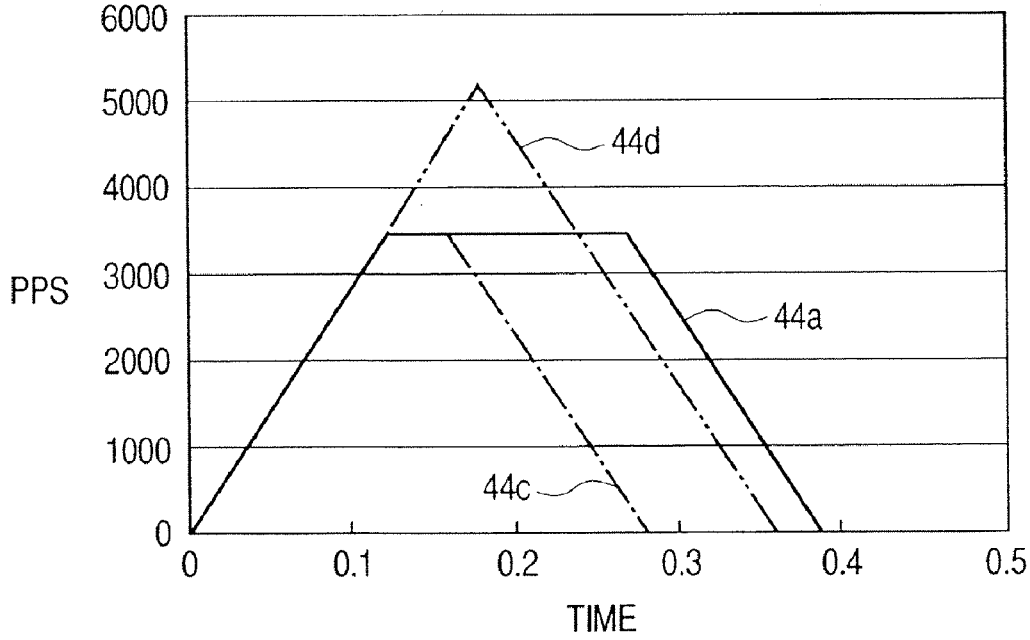
FIG. 8 is a motor table showing another example of the changing means according to the present invention.

In the present embodiment, in (1) the image forming mode, the motor tables 44*a* and 44*b* shown in FIG. 1 are used for the control of the rotation of the rotary 4 to thereby prevent color misregister. Also, in (2) the toner supplying mode which is a non-image forming mode, use is made of the motor tables 44*a* and 44*c* shown in FIG. 7 wherein the rotational speed of the rotary 4 is equivalent, and in (3) the image adjusting mode, during the 80° movement of Y→M, M→C and Bk→Y (HP) in which the moving distance is short, use is made of the same table 44*c* (dot-and-dash line) as that in (2) the toner supplying mode, and for the further shortening of time, use is made of a motor table 44*d* (dots-and-dash line) shown in FIG. 8 to thereby shorten the time in the C→Bk movement wherein the moving distance is long. That is, in the present embodiment, the motor table 44*c* is used during the 80° movement of Y→M, M→C and Bk→Y (HP) in which the moving distance is short, and the motor table 44*d* is used during the 120° movement C→Bk in which the moving distance is long. In the case of the motor table 44*d*, the speed is accelerated more to the maximum than in the case of the ordinary motor table 44*a* to thereby shorten the moving time.

In the image adjusting mode, there is incorporated a sequence for transferring the Y, M, C and Bk toner images to the ITB 2*d*, measuring the toner density by an optical sensor (not shown), and optimizing various adjusted values. Therefore, it becomes possible to make each developing device changeover time shortest to thereby shorten the image adjusting time and achieve an improvement in the adjustment down time.

Fourth Embodiment

Figure 4:
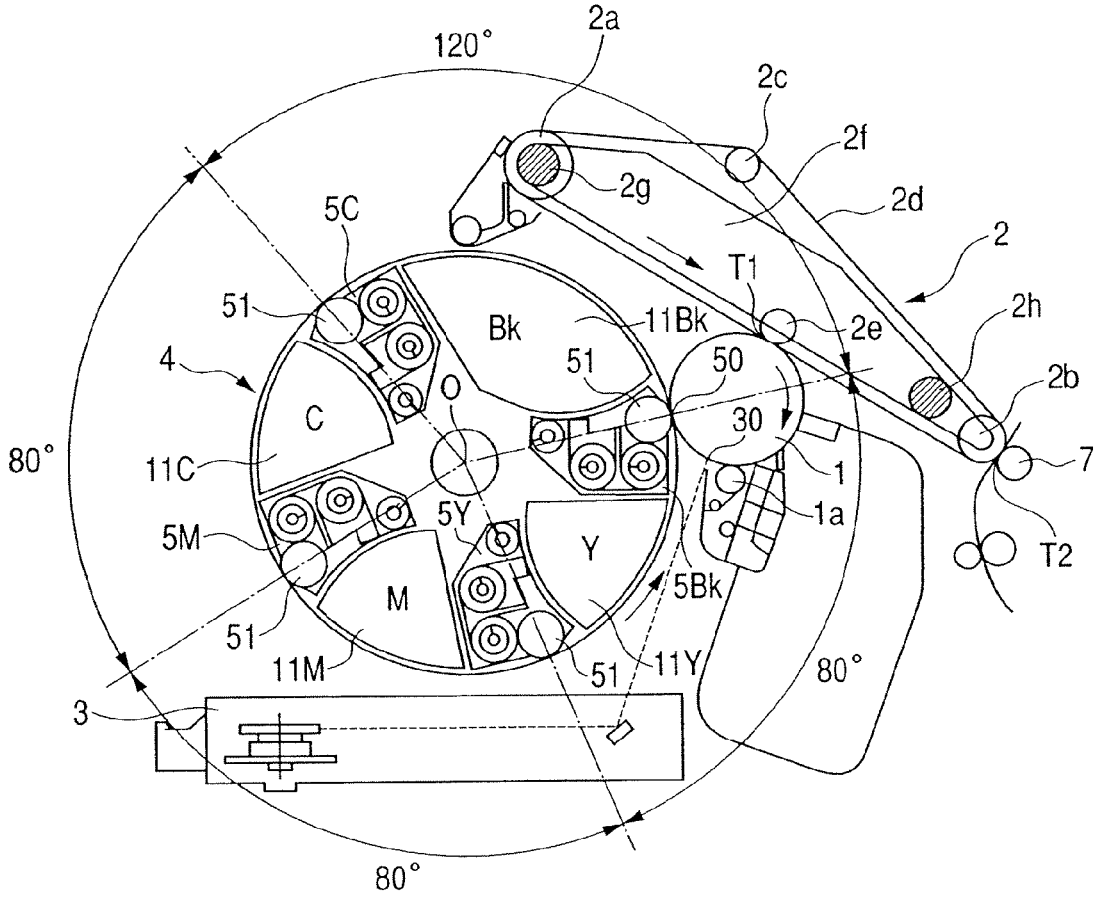
FIG. 4 is a fragmentary view showing the construction of an example of an image forming apparatus according to the present invention.
Figures 5A, 5B, 5C, 5D:
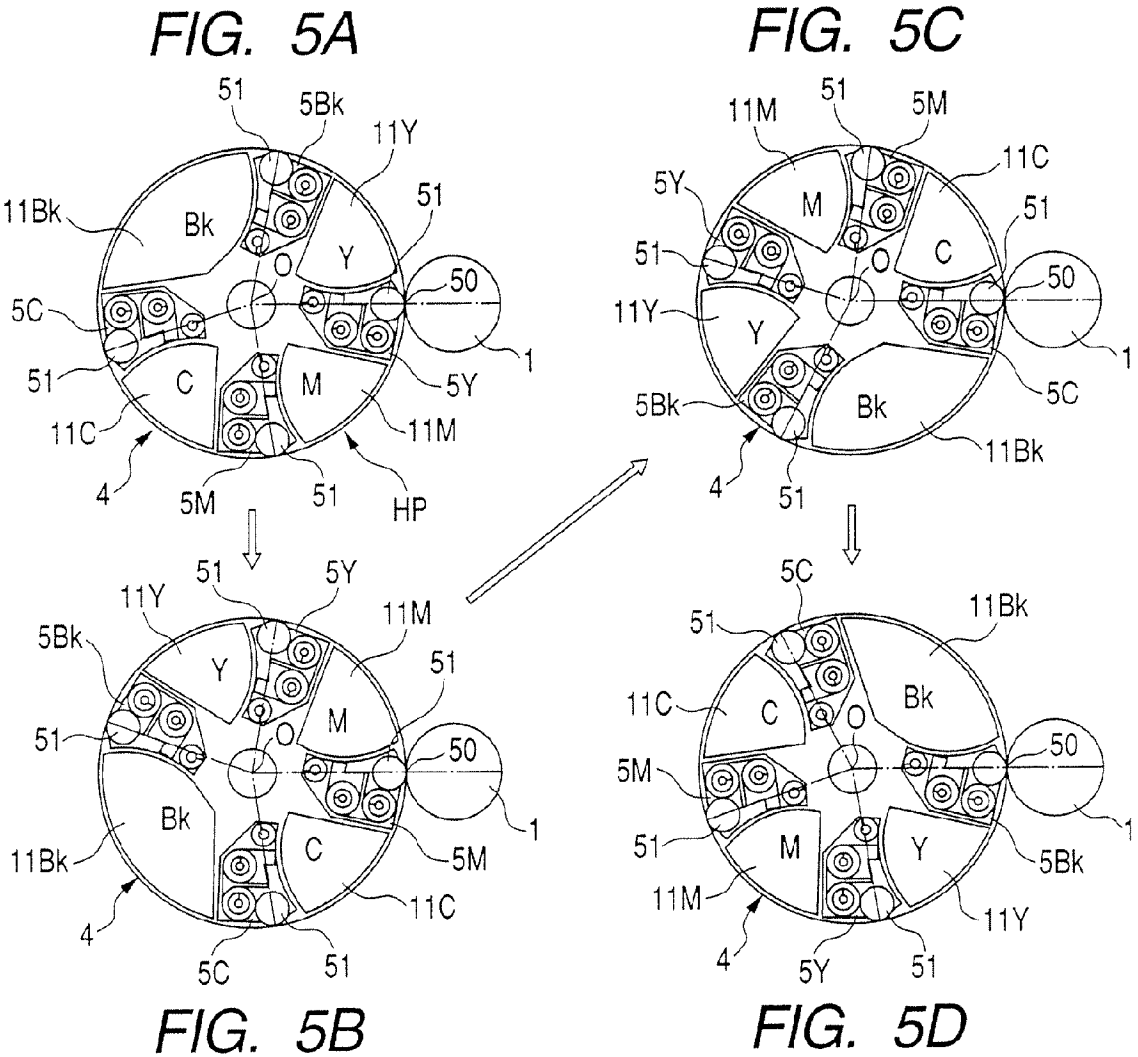
FIGS. 5A, 5B, 5C and 5D are illustrations showing an example of a moving member according to the present invention and the operation thereof.

In the first embodiment to the third embodiment, a description has been made of such an image forming apparatus as shown in FIG. 9 adopting such a construction as shown in detail in FIG. 4 which carries the developing devices 5 of four colors on the rotary 4, and conveys the developing devices 5 to the HP one by one in the order of arrangement thereof along the rotation outer periphery of the rotary 4, and having a construction in which among the developing devices 5, the Bk developing device 5Bk which is high in the frequency of use is great in the capacity of the toner container 11Bk thereof and therefore, the moving distance of the rotary 4 in C→Bk is lengthened. In the present embodiment, reference is made to FIG. 12 to describe an example in which the present invention is applied to an image forming apparatus in which the arrangement of the developing devices 5 in the rotary 4 is changed and developing devices 5 of six colors are carried on the rotary 4.

The image forming apparatus of the present embodiment is similar to the image forming apparatus shown in FIG. 9 which has been described in the first to third embodiments, except for the construction of the rotary 4, and therefore the whole of the image forming apparatus need not be described.

Figure 12:
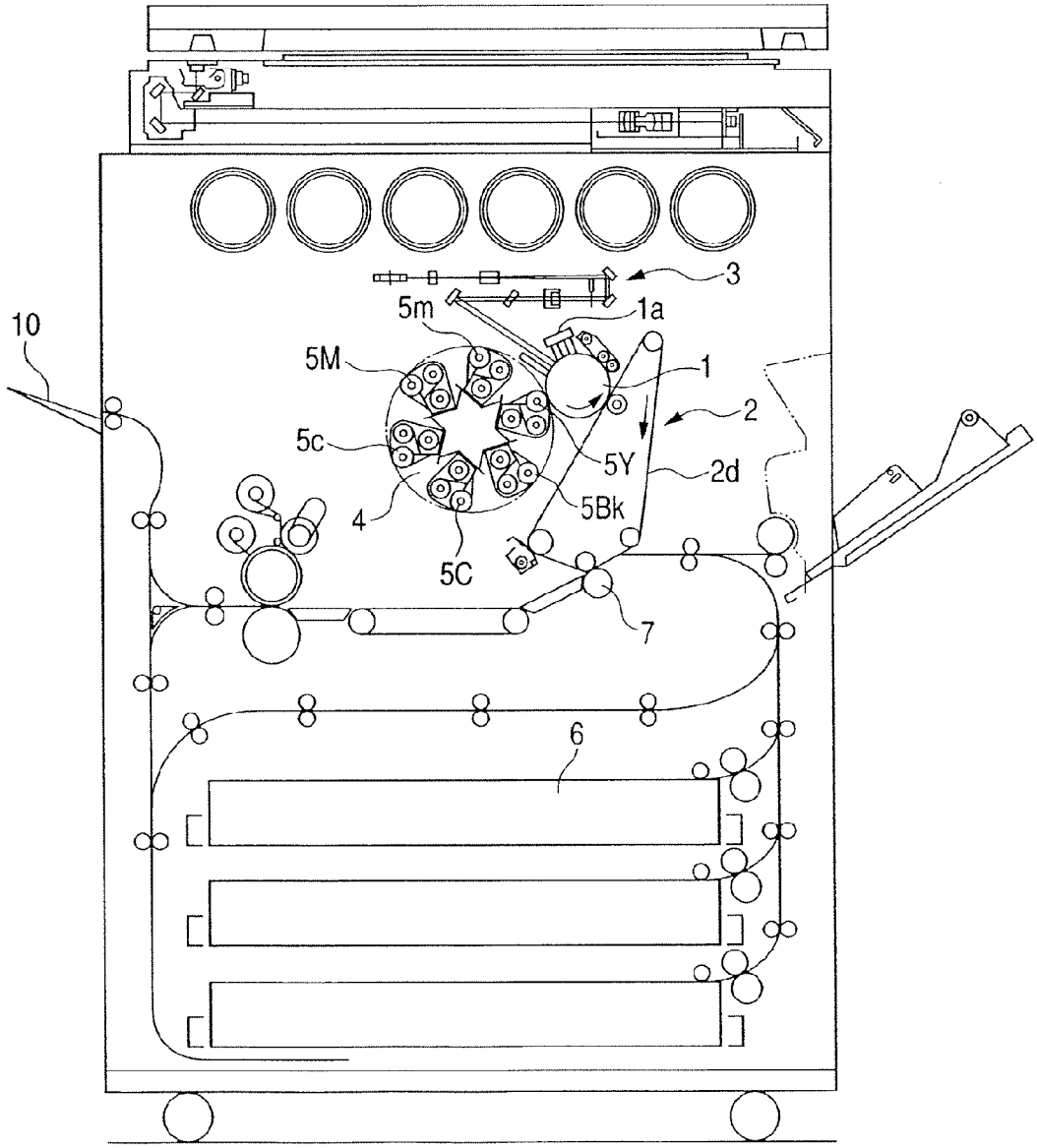
FIG. 12 is a view schematically showing the construction of another example of the image forming apparatus according to the present invention.
Figure 13:
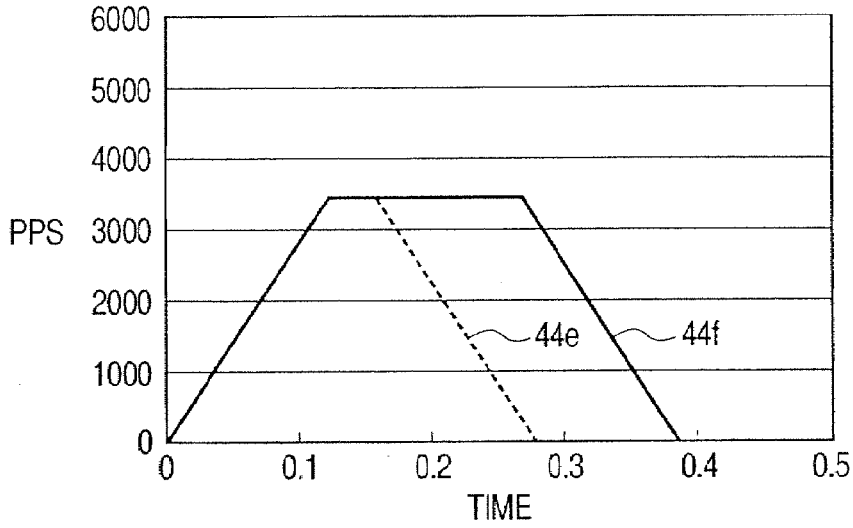
FIG. 13 is a motor table showing an example of conventional changing means.
Figure 14:
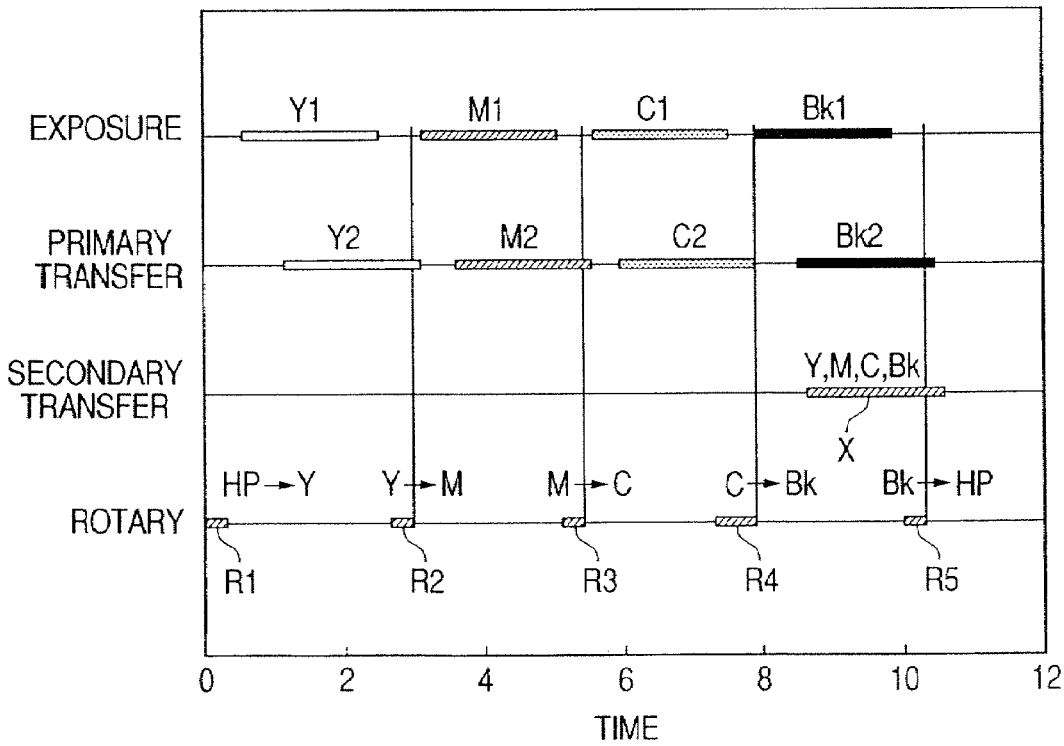
FIG. 14 is a timing chart showing an example of an operation sequence in a conventional image forming process.
Figures 15A, 15B, 15C, 15D:
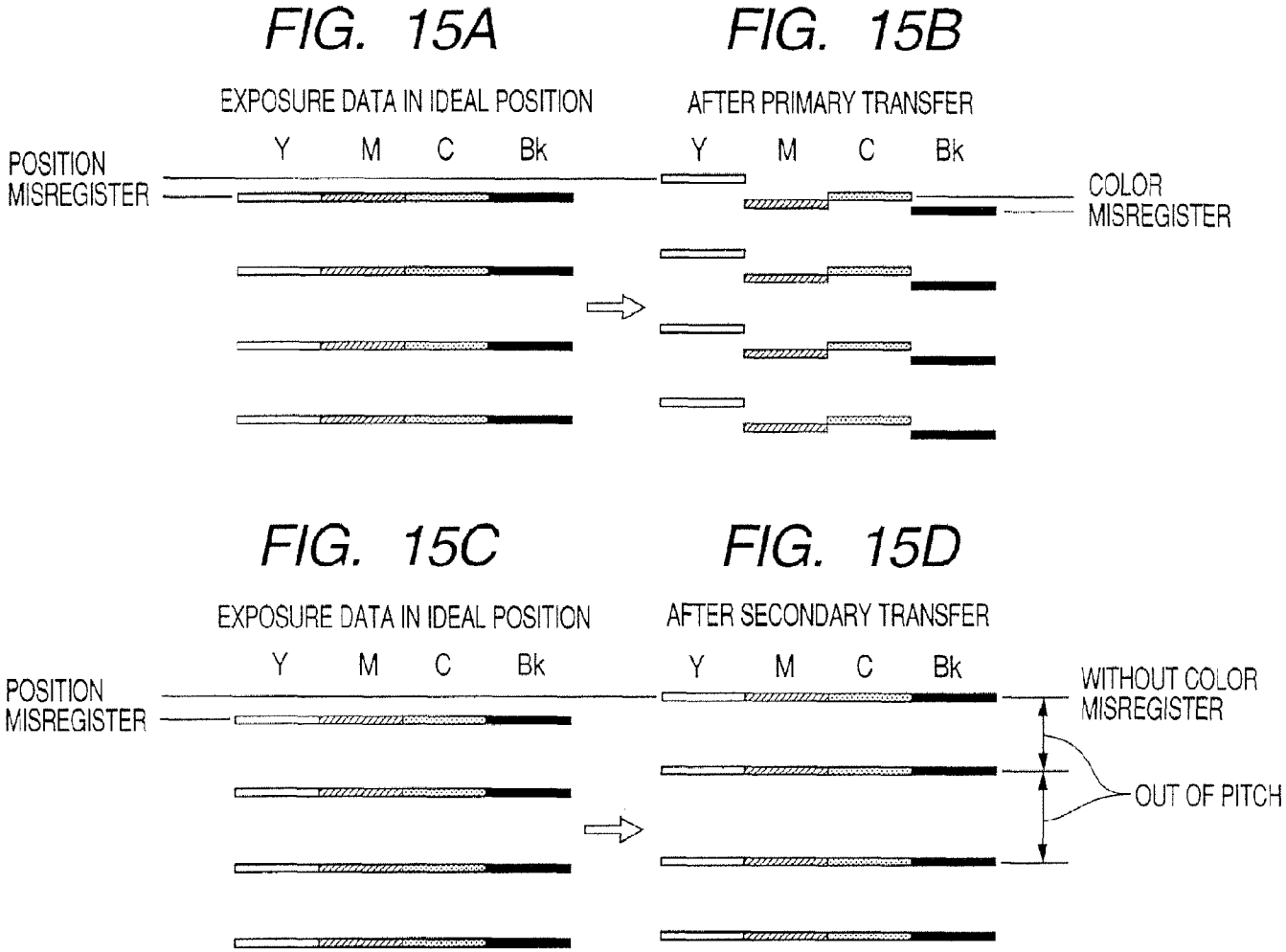
FIGS. 15A, 15B, 15C and 15D are illustrations showing the occurrence of color misregister.
Figure 16A:
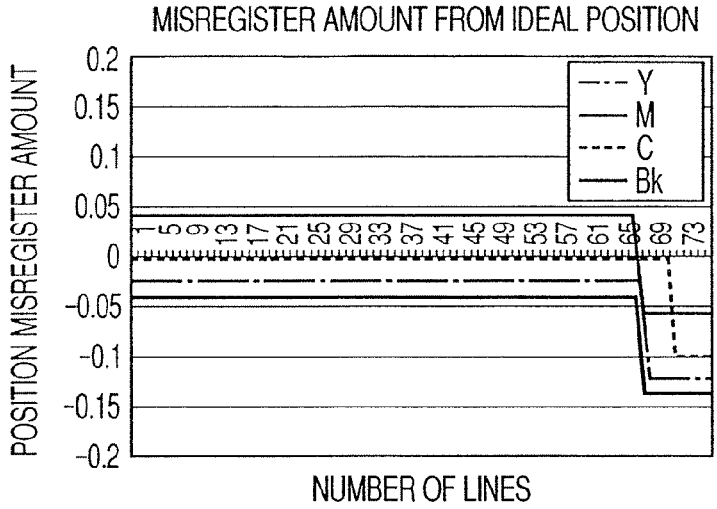
FIGS. 16A, 16B and 16C are illustrations showing color misregister amounts at a conventional image position.
Figure 16B:
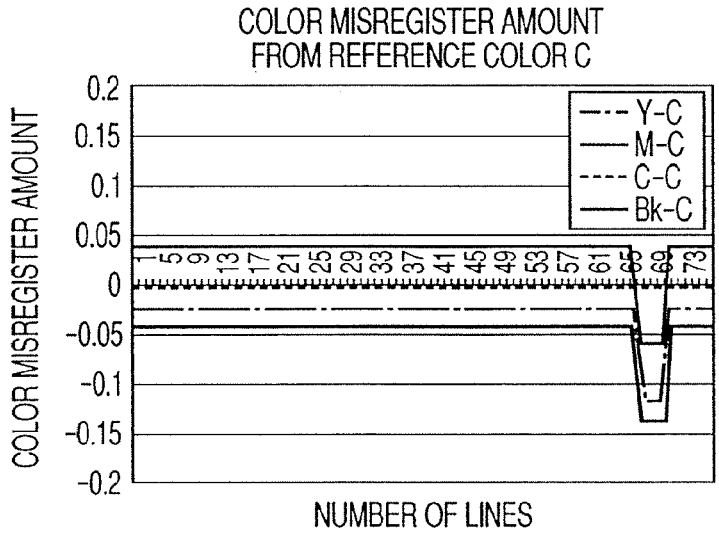
Figure 16C:
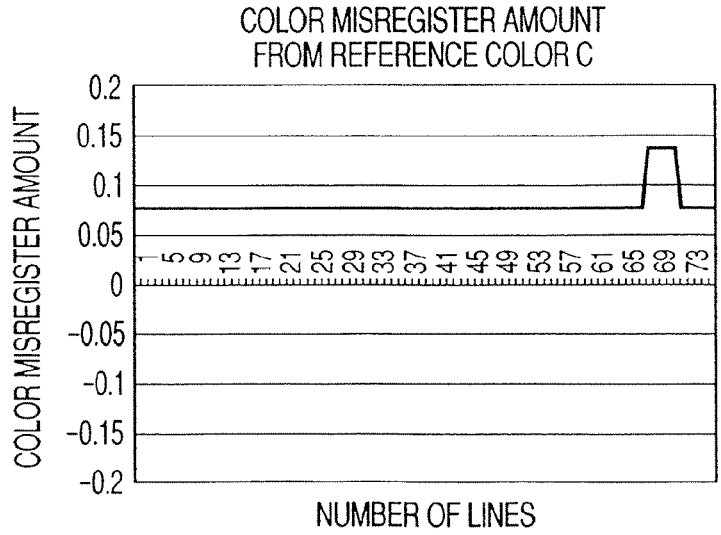

The present embodiment, as shown in FIG. 12, has a rotary 4 carrying thereon developing devices 5 of light magenta m and light cyan c, besides yellow Y, magenta M, cyan C and black Bk.

Thus, the six developing devices 5 (5Y, 5*m*, 5M, 5*c*, 5C and 5Bk) are made to correspond to a single photosensitive drum 1, and the rotary 4 is rotated to thereby change over the developing devices 5 and effect developing. Then, images of the respective colors formed on the photosensitive drum 1 are primary-transferred to an intermediate transfer belt 2*d* which is an intermediate transfer member (transfer medium), whereby multiplex transfer is effected on the intermediate transfer belt 2*d*, and the multiplexed transferred images are secondary-transferred to a recording material (transfer medium) fed from a sheet feeding apparatus 6, under the action of a secondary transfer roller 7.

The developing device 5*m* of light magenta and the developing device 5*c* of light cyan are filled with developers including toners of the same hue but lower in density than the magenta toner and the cyan toner filling the developing devices 5M and 5C, respectively. That is, these developing devices contain therein toners of two colors magenta (M) and cyan (C) of the same hue but high in density and low in density.

The toners of the same hue but of different density usually refer to toners which are equal in the spectral characteristic, but differing in the amount, of a coloring component (pigment) contained in a toner having resin and a coloring component (pigment) as a base substance. A light color toner refers to a toner relatively low in density, of a combination of toners of the same hue but differing in density. In the toners of the same hue but low in density (light color toners), the optical density after fixing is less than 1.0 per toner amount of 0.5 mg/cm$^2$ on a recording material, and in a toner high in density (deep color toner), the optical density after fixing is 1.0 or greater per toner amount of 0.5 mg/cm$^2$ on the recording material.

Now, in the present embodiment, in (1) the ordinary image forming mode, there are set two kinds of modes, i.e., (1A) a six-color image forming mode using all of the developing devices 5 of six colors, and (1B) a four-color image forming mode using the other four colors than light magenta and light cyan.

So, in (1B) the four-color image forming mode, the developing operation is performed in the order of yellow Y, magenta M, cyan C and black Bk, and there are a case where the moving distance of the rotary 4 is long and a case where the moving distance of the rotary 4 is short, and motor control using the two kinds of motor tables 44*a* and 44*b* shown in FIG. 1 is carried out.

Again in such an image forming apparatus, the rotating time of the rotary 4 for each color is made equivalent to thereby adjust the position misregister occurring position to the images, whereby color misregister can be prevented.

As a range within which the moving times to the developing position in the present embodiment become substantially equal, a range in which a time required for the drum moving a predetermined distance fluctuates when the rotational speed of the drum fluctuates within a range of −0.2% to 0.2% is preferable, and the more approximate to 0, the better.

This application claims priority from Japanese Patent Application No. 2004-008557 filed on Jan. 15, 2004, which is hereby incorporated by reference herein.

What is claimed is:

1. An image forming apparatus comprising:

an electrostatic image forming device for forming an electrostatic image on an image bearing member;

a plurality of developing devices, each having a different color developer for developing the electrostatic image formed on the image bearing member at a developing position;

a moving member holding said plurality of developing devices for selectively moving said plurality of developing devices to the developing position;

a plurality of developer supplying containers for supplying the developers to said plurality of developing devices, respectively, said plurality of developer supplying containers being held by said moving member;

a controller for controlling a movement of said moving member to successively move a plurality of selected developing devices to the developing position in an image forming operation, wherein a moving distance in at least one moving operation in a plurality of moving operations of said moving member is different from a moving distance in other moving operations in the plurality of moving operations;

a primary transferring device for successively transferring each developer image formed by each developing device moved to the developing position onto an intermediate transfer member in a primary transfer position in a superimposing manner; and a secondary transferring device for transferring developer images, which have been transferred on said intermediate transfer member in the superimposing manner, onto a recording material conveyed to a secondary transfer position, wherein said controller performs the at least one moving operation and some moving operations of the other moving operations during a transfer operation by said primary transferring device, and wherein said controller controls a moving speed of said moving member so that a relative position of a trailing edge of an image forming region on the image bearing member with respect to the developing position when the at least one moving operation is completed and a relative position of the trailing edge of the image forming region on the image bearing member with respect to the developing position when the other moving operations are completed become substantially equal to each other, wherein said controller controls the moving speed of said moving member so that said moving member is moved at a uniform speed when said moving member is moved in order to perform a developer supplying operation in a non-image forming operation.

2. An image forming apparatus according to claim 1, wherein said controller controls the moving speed of said moving member so that a time required for the at least one moving operation and a time required for each of the other moving operations become substantially equal to each other.

3. An image forming apparatus according to claim 2, wherein when the moving distance in the at least one moving operation is longer than the moving distance in each of the other moving operations, said controller controls the moving speed of said moving member so that a maximum moving speed in the at least one moving operation becomes higher than a maximum moving speed in the other moving operations.

* * * * *

UNITED STATES PATENT AND TRADEMARK OFFICE

CERTIFICATE OF CORRECTION

PATENT NO. : 7,315,714 B2
APPLICATION NO. : 11/538653
DATED : January 1, 2008
INVENTOR(S) : Shinichiro Wakahara It is certified that error appears in the above-identified patent and that said Letters Patent is hereby corrected as shown below:

COLUMN 9:

Line 26, Close up left margin.
Line 27, Close up left margin.
Line 31, "the" should be deleted.

COLUMN 11:

Line 56, "(timing Y2);" should read --(timing Y2).--.

Signed and Sealed this

Twenty-ninth Day of July, 2008

JON W. DUDAS
*Director of the United States Patent and Trademark Office*